United States Patent [19]

Gatin

[11] Patent Number: 4,907,802

[45] Date of Patent: Mar. 13, 1990

[54] BALL THROWING APPARATUS

[76] Inventor: Walter L. Gatin, R.R.1, S12, C64, Chase, B.C., Canada, VOE 1MO

[21] Appl. No.: 352,438

[22] Filed: May 16, 1989

[51] Int. Cl.[4] ..... A63B 69/40

[52] U.S. Cl. ..... 273/26 R; 273/26 D; 273/29 A; 124/7; 124/51 R; 124/36

[58] Field of Search ..... 273/26 D, 26 R, 29 A, 273/129 R, 129 V, 129 W; 124/4, 6, 8, 36, 7, 34, 41 R, 50, 81, 17, 51

[56] References Cited

U.S. PATENT DOCUMENTS

| | | | |
|---|---|---|---|
| 202,301 | 4/1878 | Taltavull | 124/36 |
| 1,825,882 | 10/1931 | Mauney | 273/26 D |
| 2,080,958 | 5/1937 | Beasley et al. | 124/7 |
| 2,147,705 | 2/1939 | Hunter | 273/26 R |
| 2,585,989 | 2/1952 | Atwell | 273/26 R |
| 3,892,217 | 7/1975 | Raty | 124/7 |
| 4,082,076 | 4/1978 | Perry | 124/7 |
| 4,209,003 | 6/1980 | Sainbury | 124/7 |
| 4,524,749 | 6/1985 | Giovagnoli | 124/7 |
| 4,538,810 | 9/1985 | Brophy | 124/50 |
| 4,809,196 | 12/1988 | Powell et al. | 124/7 |

*Primary Examiner*—T. Brown

*Attorney, Agent, or Firm*—Townsend and Townsend

[57] ABSTRACT

A ball throwing apparatus capable of releasing balls at selected intervals and selected trajectories, and operable from a remote location. The apparatus comprises a base and a throwing arm mounted on the base for pivotal movement between a ball loading position and a released position. There is a ball receiving aperture for holding a ball to be thrown mounted on the throwing arm. A suction cup element is positioned to be depressible by the throwing arm so as to releasably hold the throwing arm in the ball loading position. A slow leak is created in the suction cup for releasing the hold of the suction cup element after a short delay to allow the user time to prepare for the throwing of the ball. An actuating spring attached to the throwing arm acts to move the arm from the ball loading position to the released position upon release of the throwing arm by the suction cup element, the movement of the throwing arm between the positions resulting in a throwing motion. An automatic ball loading mechanism and a remote operating mechanism are provided. The apparatus also includes a mechanism for controlling the speed at which the ball is thrown.

22 Claims, 3 Drawing Sheets

BALL THROWING APPARATUS

FIELD OF THE INVENTION

This invention relates to an apparatus for throwing balls, and more particularly to a self-releasing, ball throwing arm that can be operated from a distance.

BACKGROUND OF THE INVENTION

Ball throwing devices are useful as practice devices in games that involve hitting a ball such as baseball, softball, cricket or tennis.

Prior art devices for throwing balls and supplying balls to throwing machines are well known. Examples of such devices are shown in the following U.S. Patents:

U.S. Pat. No. 3,892,217 to Raty
U.S. Pat. No. 4,082,076 to Perry
U.S. Pat. No. 4,209,003 to Sainsbury
U.S. Pat. No. 4,538,810 to Brophy
U.S. Pat. No. 4,524,749 to Giovagnoli
U.S. Pat. No. 202,301 to Taltavull Raty discloses a device that requires a human attendant to be standing by in order to aim the device and keep it supplied with balls.

Brophy discloses a baseball dispensing device that supplies balls at timed intervals to a ball throwing machine.

The remaining patents disclose ball throwing mechanisms that use a complex arrangement of gears and cams to achieve delayed release of the balls. Many of the devices require an electric motor or similar power source to operate.

Ideally, a ball throwing machine should provide a player with a tireless partner that supplies balls as desired at a selected trajectory so that the player can develop or improve his hand-eye coordination. It is important that the ball throwing machine have means to delay release of a ball once the throwing machine is activated to give the user time to get ready for the ball. In this regard, remote operation of the ball throwing apparatus is desirable so that the player can be standing in a ready position some distance away from the apparatus.

The ball throwing apparatus of the present invention can provide all of these desirable features and provides a simple and reliable ball throwing apparatus that can be operated by a single person from a distance. Unlike prior art devices, the apparatus of the present invention requires no motorized actuating means. In addition, the ball throwing apparatus of the present invention uses a unique means for delaying release of the ball to be thrown comprising a slow leaking suction cup element that can be adjusted to vary the delay time. The apparatus is adjustable so that the speed and trajectory of the ball being thrown can be varied.

SUMMARY OF THE INVENTION

Accordingly, the present invention is a ball throwing apparatus comprising:

a base;

a throwing arm mounted on said base for pivotal movement between a ball loading position and a released position;

ball receiving means for holding a ball to be thrown mounted on said throwing arm;

a suction cup element positioned to be depressible by said throwing arm to releasably hold said throwing arm in said ball loading position;

leaking means for releasing the hold of said suction cup element;

actuating means attached to said throwing arm for moving said arm from said ball loading position to said released position upon release of said throwing arm by said suction cup element, the movement of said throwing arm between said positions resulting in a throwing motion.

The ball throwing apparatus can be operated from a remote location and means are provided for automatically loading balls into the machine. In addition, means are also provided for adjusting the time delay of the suction cup element and adjusting the speed and trajectory of a ball being thrown.

BRIEF DESCRIPTION OF THE DRAWINGS

Aspects of the present invention are shown in the accompanying drawings in which.

DESCRIPTION OF THE PREFERRED EMBODIMENTS

Figures 1, 2, 5, 6:
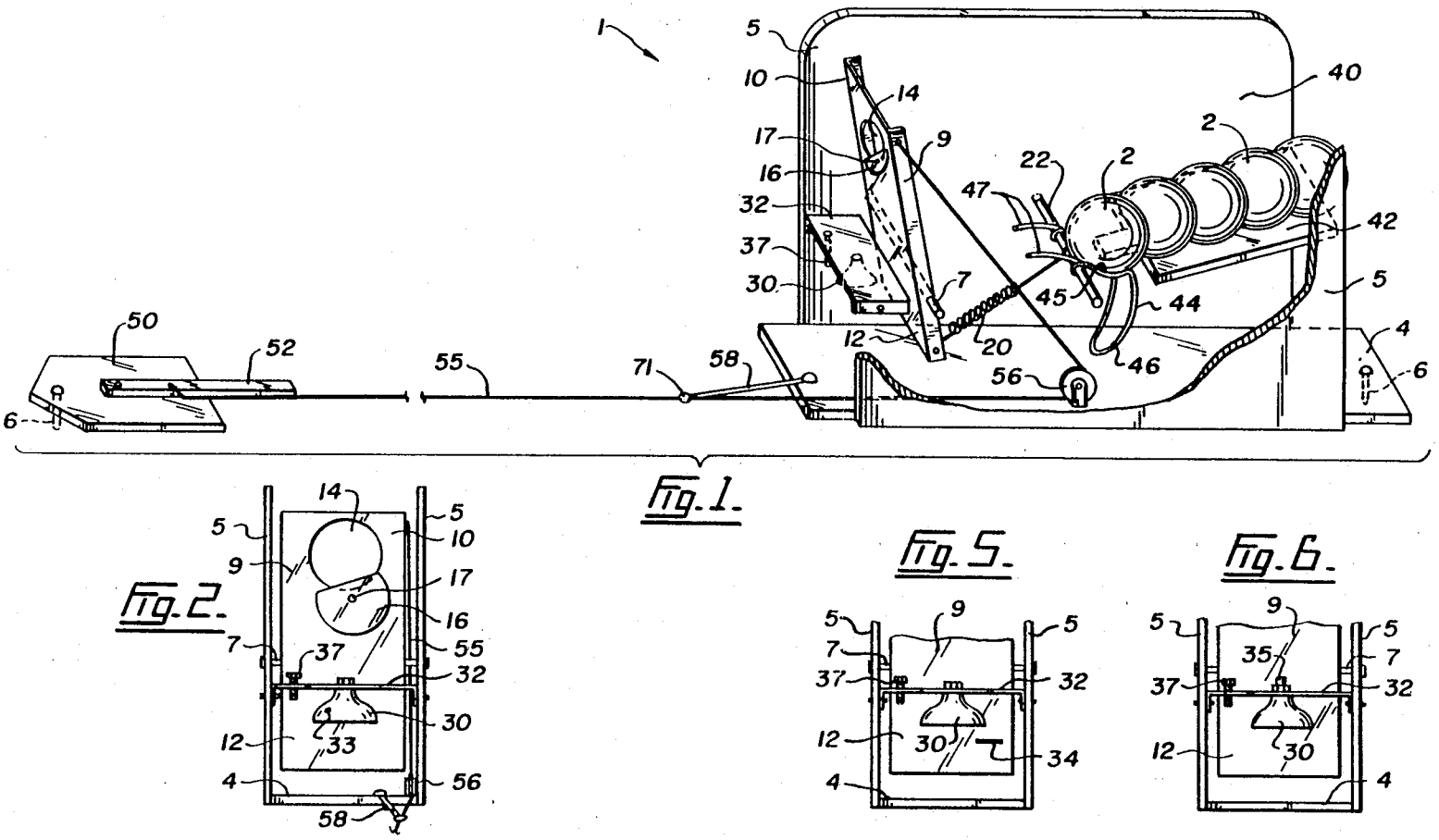
FIG. 1 shows an embodiment of the ball throwing apparatus and its remote operating mechanism in a released position.
FIG. 2 is a front view of the ball throwing apparatus in its released position.
FIG. 5 is a front view of the ball throwing apparatus showing alternative leaking means for releasing the suction cup comprising a shallow slot.
FIG. 6 is a front view of the ball throwing apparatus showing alternative leaking means comprising an adjustable valve.
Figure 3:
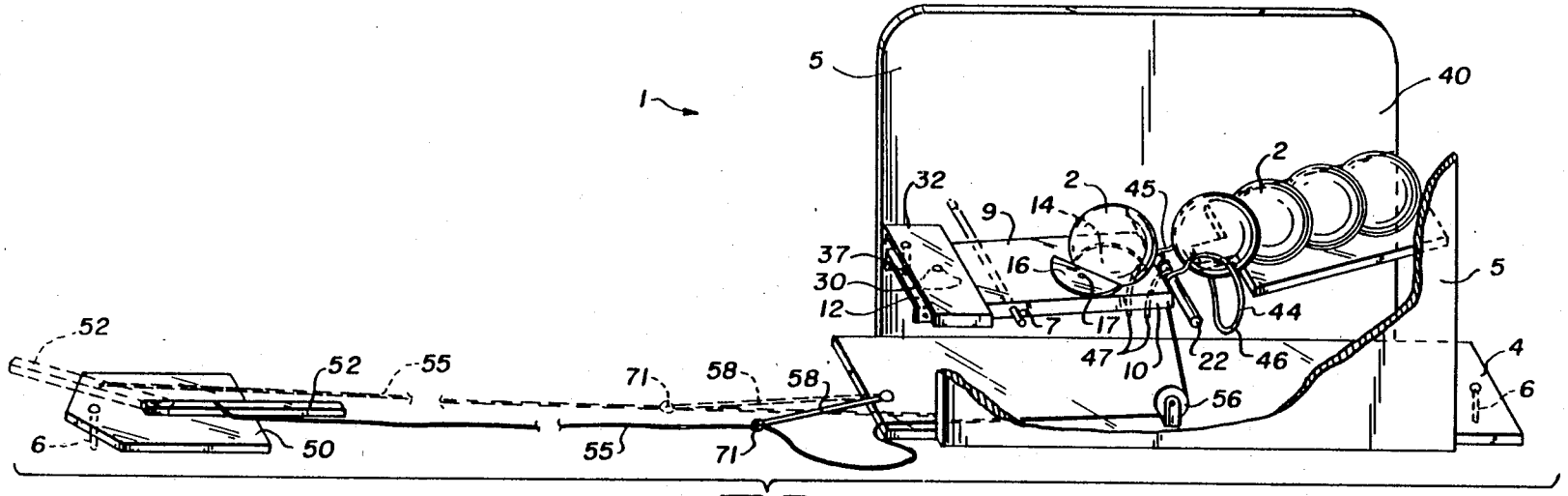
FIG. 3 shows the ball throwing apparatus and its remote operating mechanism in the ball loading position.

In FIGS. 1 to 7, a first embodiment of the ball throwing apparatus 1 is shown comprising a base 4 having parallel upstanding side members 5. Base 4 is provided with spike 6 so that it can be anchored to the ground. Pivotally mounted between the side members about axle 7 is a throwing arm 9. Throwing arm 9 is pivotable between the two positions shown in FIGS. 1 and 3. FIG. 1 shows arm 9 in its released position after throwing a ball 2 and FIG. 3 shows the arm in its ball loading position prior to throwing a ball 2.

In the illustrated embodiment, throwing arm 9 is a rectangular member having a first end 10 and a second end 12. The rectangular member comprises has a shallow U cross-section and axle 7 extends through the sides of the U about an axis that is intermediate the first and second ends.

Figure 7:
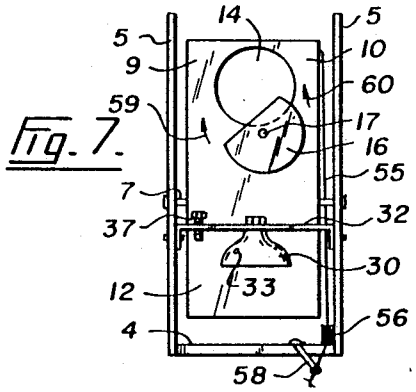
FIG. 7 shows the means to adjust the trajectory of a ball.

First end 10 is formed with ball receiving means comprising an essentially circular aperture 14 to receive a ball 2. As best shown in FIG. 7, aperture 14 is partially covered by means to adjust the trajectory of a thrown ball comprising a movable disc 16 mounted to the throwing arm at 17. Disc 16 can be rotated about point 17 either clockwise or counterclockwise, as indicated by arrows 59 and 60, respectively, to adjust the area of aperture 14 covered by the disc. In this manner, disc 16 affects the seating depth of a ball in aperture 14 thereby altering the trajectory of the ball when thrown by throwing arm 9. A ball that is seated deeply within ball receiving aperture 14 will tend to be released at a later time during the throwing motion of arm 9 so that a lower trajectory results. Likewise, a ball that is seated to a shallow depth will follow a higher trajectory.

Second end 12 of throwing arm 9 has attached actuating means comprising a spring 20 that extends rearwardly toward first end 10 under the throwing arm. Spring 20 extends between second end 12 of throwing arm 9 and support 22 that extends between side members 5. When throwing arm 9 is moved to the ball loading position of FIG. 3, spring 20 is stretched creating a restoring force that acts to pivot throwing arm 9 from its ball loading position to its released position as shown in FIG. 1. The movement of the throwing arm from the ball loading position to the released position providing the throwing motion that delivers a ball 2.

Figure 4:
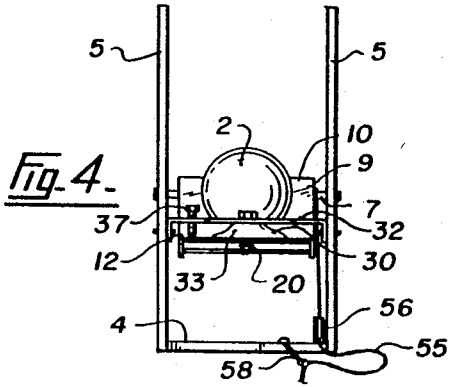
FIG. 4 is a front view of the ball throwing apparatus in its ball loading position.

When in the ball loading position of FIG. 3, suction cup element 30 mounted beneath support member 32 acts to hold the throwing arm in position against the restoring force of stretched spring 20. Support member 32 and suction cup element 30 are positioned between side members 5 such that the suction cup is depressed by second end 12 of throwing arm 9 whenever the throwing arm is pivoted to the ball loading position of FIG. 3. This depression of suction cup element 30 is best shown in FIG. 4. Suction cup element 30 engaging second end 12 creates a suction grip on the throwing arm that holds the arm in the ball loading position against the restoring force of spring 20.

Leaking means for slowly releasing the suction grip of suction cup 30 are provided. In the illustrated embodiment of FIG. 2, this leaking means comprises a small perforation 33 in the body of the suction cup that will allow for a slow equalization of pressure between the interior of the cup and the outside. At a certain point, the restoring force of spring 20 will be sufficient to overcome the weakening suction grip of cup 30 and throwing arm 9 will be released from its ball loading position. This delay allows the user time to prepare for throwing of the ball. As arm 9 moves to the released position, ball 2 is thrown by the apparatus.

Alternatively, as shown in FIG. 5, the leaking means can comprise a shallow slot 34 formed on second end 12 of throwing arm 9. Slot 34 is formed on second end 12 such that the slot will connect the interior of suction cup 30 with the exterior when the throwing arm is in the ball loading position thereby allowing pressures to equalize and slowly reducing the grip of the suction cup element 30.

As a further alternative shown in FIG. 6, the leaking means can comprise an adjustable valve 35 extending upwardly from the top of support member 32 and communicating with the interior of suction cup 30. Adjusting the flow through the valve allows the user to adjust the time delay between activating the throwing apparatus by placing the throwing arm in the ball loading position and when the ball is actually thrown. This time delay allows the user time to prepare for the throwing of the ball.

When the leaking means comprises perforation 33 or shallow slot 34, timing means to adjust the time delay of said suction cup element comprises an adjustable stop member 37 that extends through support member 32. In FIGS. 2 and 3, stop member 37 comprises a threaded bolt in a correspondingly threaded hole. By rotating stop member 37 in and out of the threaded hole, it is possible to vary the travel of second end 12 upward toward support member 32. Therefore, stop member 37 can be used to adjust the extent to which suction cup element 30 is depressed against the throwing arm. If stop member 37 is raised, suction cup element 32 can be depressed to a greater extent resulting in a stronger grip of the throwing arm and a longer time delay before the ball is released. Conversely, if stop member 37 is lowered, a shorted time delay will result.

The ball throwing apparatus of the present invention is also equipped with ball supply means and automatic ball loading means to supply balls to the throwing arm.

The ball supply means comprises a magazine enclosure 40 having a sloped base 42. The enclosure 40 is defined by side members 5 and the base. Balls are fed by gravity to the throwing arm.

The automatic ball loading means acts to supply the balls to the ball receiving means of the throwing arm each time the throwing arm is pivoted to the ball loading position. The automatic ball loading means comprises a pivotable bail 44 rotatable about support member 22. The bail is a curvilinear wire formed with a depression 45 to accept a single ball. The bail is formed with an elongated tail 46 that tends to cause the bail to rotate to a rest position shown in FIG. 1 wherein a ball rests in depression 45 and prevents other balls from exiting the enclosure. A pair of prongs 47 extend in the opposite direction to tail 46. Prongs 47 are engaged by the underside of throwing arm 9 when the throwing arm is pivoted to its ball loading position causing the bail to pivot about support member 22 as shown in FIG. 3. This pivoting action causes the ball in depression 45 to be loaded into aperture 14 of the throwing arm ready prior to throwing of the ball. At the same time, elongated tail 46 is rotated upward to prevent balls from exiting the enclosure 40. After throwing arm 9 moves to its released position, bail 44 rotates back to its rest position and the next ball rolls into depression 45.

The ball throwing apparatus of the present invention is also equipped with means for remotely operating the apparatus comprises a remote base 50 having an actuating lever 52 pivotally attached. Base 50 has spike 6 to anchor the base to the ground. Connecting means comprising a non-stretchable cable 55 join the actuating lever to first end 10 of throwing arm 9. Cable 55 is looped about wheel 56 between side members 5. When actuating lever 52 is rotated about its attachment to base 50 as shown by dashed lines in FIG. 3, throwing arm 9 is pivoted from its rest position to its ball loading position where the arm is held by suction cup 30. Actuating lever 52 is operated by the hand of the user.

Cable 55 is provided with means for retrieving slack comprising a resilient member 58 such as a rubber band or bungie cord extending from base 4 to cable 55. Resilient member 58 causes slack in cable 55 to be brought toward base 4.

Figure 8:
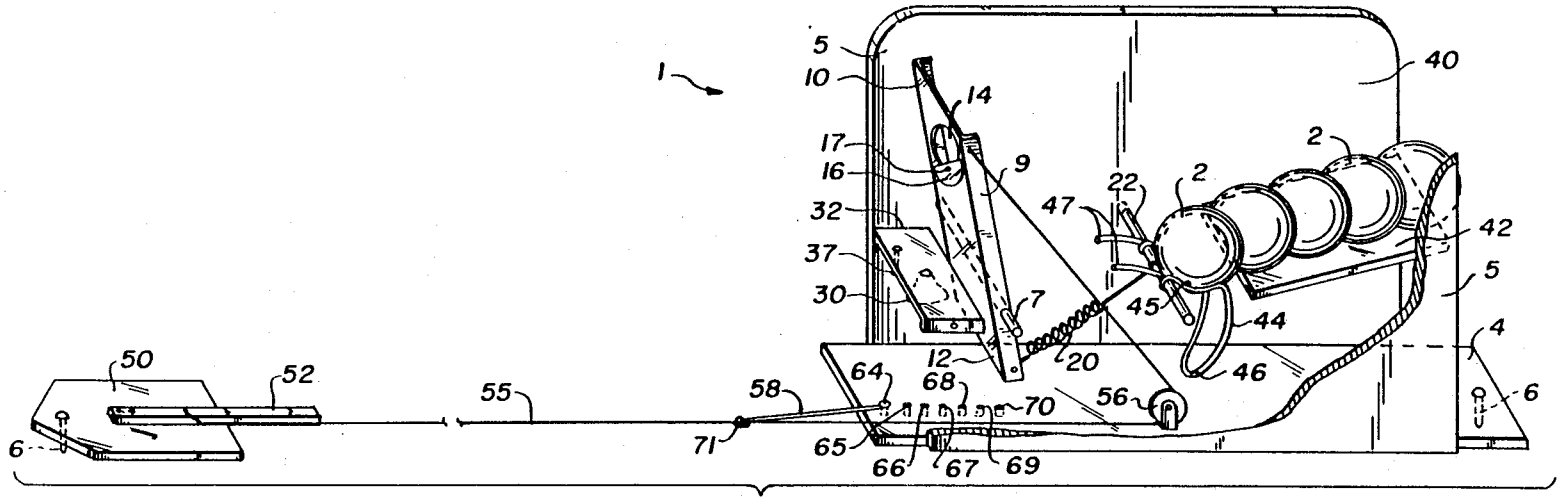
FIG. 8 shows an alternative embodiment of the present invention with means to adjust the speed at which the ball is thrown.

FIG. 8 shows a second embodiment of the present invention with means to adjust the speed at which the ball is thrown comprising a plurality of locations 64 to 70 on base 4 to which an end 61 of resilient member 58 can be releasably attached. This arrangement serves to vary the speed at which a ball is thrown by arm 9 by acting to vary the drag force on arm 9 as it rotates between its ball loading position and its released position. Resilient member 58 extends between a fixed point 71 on non-stretchable cable 55 and an attachment point at locations 64 to 70 that can be varied by the user. When lever 52 is used to prepare the apparatus for throwing a ball, cable 55 and point 71 are pulled toward plate 50 causing throwing arm 9 to pivot about axis 7 and engage suction cup element 30 thereby placing the apparatus in the ball loading position. As cable 55 moves toward base 50, resilient member 58 is stretched creating a restoring force in the member. When lever 52 is released, the throwing arm is held in the ball loading position by suction cup element 30 and resilient member 58 acts to draw cable 55 back toward base 4. The restoring force is directly proportional to the extension of the resilient member, and therefore, the restoring force is much greater when end 61 of resilient member 58 is located at position 70 than when the end 61 is located at position 64 since the resilient member is stretched to a much greater extent when anchored at position 70 and lever 52 is pivoted. A greater restoring force will act to bring more slack in cable 55 toward base 4 when lever 52 is released. If resilient member 58 retrieves more cable slack toward the base, arm 9 will have to do less work moving forward against the drag of the cable and will therefore tend to move forward at greater speed and impart a faster velocity to the ball being thrown. In effect, resilient member 58 acts to retrieve slack in cable 55 to adjust the drag that arm 9 experiences. The more slack that is retrieved, the less the drag force on arm 9 due to pulling cable 55. With the above described arrangement, attaching end 61 of resilient member 58 at position 60 will result in the slowest ball speed and attaching end 61 at point 70 will result in the fastest ball speed. The intermediate positions can be used to adjust the ball speed within this range.

In the embodiment of FIG. 8, positions 64 through 70 comprise threaded holes in base 4 adapted to accept a threaded fastener attached at end 61 of resilient member 58. Resilient member 58 can be a large rubber band or a bungie cord. This arrangement provides for easy adjustment of the speed of the ball by the user.

In operation, the ball throwing apparatus of the present invention is used in the following manner:

Base 4 and remote base 50 are anchored to the ground a distance apart equal to the length of cable 55. A supply of balls 2 are loaded into enclosure 40. The timing means to adjust the time delay of the suction cup element, the means to adjust the trajectory of the ball, and the means to adjust the speed of the ball are set to desired settings. The user then moves to remote base 50 and does not have to approach base 4 again except to load another supply of balls.

At remote base 50, the user gets into a ready position and activates lever 52 with his hand. Throwing arm 9 is pivoted from its released position against the force of actuating spring 20. First end 10 of the throwing arm engages bail 44 and a single ball 2 is loaded into aperture 14. At the same time as the ball is being loaded, second end 12 of the throwing arm is depressing suction cup 30.

When actuating lever 52 is released, the throwing arm is held in the ball loading position against the restoring force of tensioned spring 20 by suction cup 30. Resilient member 58 retrieves any slack in line 55 as required for ball speed control and lever 52 is returned to its starting position.

The user now has the delay period previously set to get ready for the ball to be thrown. Leaking means in suction cup 30 causes the cup to slowly loose its grip on throwing arm 9. Eventually, the suction cup looses its grip and spring 20 causes the throwing arm to pivot quickly about axle 7. This pivoting causes the throwing arm to launch ball 2 toward the user on the pre-selected trajectory.

The invention of the present invention provides a simple, inexpensive and adjustable means for a player to practice catching or batting an accurately thrown ball without the need of a partner.

Although the present invention has been described in some detail by way of example for purposes of clarity and understanding, it will be apparent that certain changes and modifications may be practiced within the scope of the appended claims.

I claim:

1. A ball throwing apparatus comprising:
   - a base;
   - a throwing arm mounted on said base for pivotal movement between a ball loading position and a released position;
   - ball receiving means for holding a ball to be thrown mounted on said throwing arm;
   - a suction cup element positioned to be contacted and depressed by said throwing arm to releasably hold said throwing arm in said ball loading position;
   - leaking means for releasing the hold of said suction cup element;
   - actuating means attached to said throwing arm for moving said arm from said ball loading position to said released position upon release of said throwing arm by said suction cup element, the movement of said throwing arm between said positions resulting in a throwing motion.

2. A ball throwing apparatus as claimed in claim 1 including ball supply means with automatic loading means to supply balls to said throwing arm.

3. A ball throwing apparatus as claimed in claim 2 in which said ball supply means comprises an enclosure having a sloped base to deliver balls by gravity to said receiving means of said throwing arm when said arm is in the ball loading position.

4. A ball throwing apparatus as claimed in claim 2 in which said automatic loading means comprises a pivotable bail comprising a curvilinear wire with a depression for accepting a single ball, said bail having a rest position wherein a ball resting in said depression prevents other balls from exiting said ball enclosure, and said bail being pivotable from its rest position to an unloading position wherein said bail is pivoted by said throwing arm such that said ball in said depression is released into said ball receiving means of said throwing arm.

5. A ball throwing apparatus as claimed in claim 2 in which said base is provided with a pair of parallel upstanding side members and said ball supply means comprises an inclined plane mounted between said side members.

6. A ball throwing apparatus as claimed in claim 1 including timing means to adjust the time delay of said suction cup element.

7. A ball throwing apparatus as claimed in claim 6 in which said timing means comprises an adjustable stop member to control the extent to which said suction cup element is depressed against said throwing arm.

8. A ball throwing apparatus as claimed in claim 1 in which said actuating means comprises a spring.

9. A ball throwing apparatus as claimed in claim 1 in which said leaking means comprises a perforation in said suction cup element.

10. A ball throwing apparatus as claimed in claim 1 in which said throwing arm has a first end formed with said ball receiving means, and a second end attached to said arm actuating means, said throwing arm being pivotally mounted about an axis intermediate said first and second ends and said second end engaging said suction cup element when said throwing arm is in the ball loading position.

11. A ball throwing apparatus as claimed in claim 10 in which said leaking means is a shallow slot formed in said second end of said throwing arm and positioned such that said slot connects the interior and exterior of said suction cup element when said throwing arm is in said ball loading position.

12. A ball throwing apparatus as claimed in claim 1 in which said leaking means comprise an adjustable valve in said suction cup element.

13. A ball throwing apparatus as claimed in claim 1 in which said receiving means of said throwing arm comprises an essentially circular aperture in said arm to receive a ball.

14. A ball throwing apparatus as claimed in claim 13 including means to adjust the trajectory of a thrown ball.

15. A ball throwing apparatus as claimed in claim 14 in which said means to adjust the trajectory of a thrown ball comprises a movable disc to partially cover said essentially circular aperture thereby adjusting the seating depth of a ball in said aperture.

16. A ball throwing apparatus as claimed in claim 1 including means for remotely operating said ball throwing apparatus comprising:

a remote base;

an actuating lever pivotally mounted to said remote base;

connecting means joining said actuating lever and said throwing arm whereby operating said actuating lever acts through said connecting means to move said throwing arm from said released position to said ball loading position.

17. A ball throwing apparatus as claimed in claim 16 in which said connecting means is a cable.

18. A ball throwing apparatus as claimed in claim 16 including means for retrieving slack in said connecting means.

19. A ball throwing apparatus as claimed in claim 18 in which said means for retrieving slack is a resilient member mounted between said base and said connecting means.

20. A ball throwing apparatus as claimed in claim 16 including means to adjust the speed at which the ball is thrown.

21. A ball throwing apparatus as claimed in claim 20 in which said means to adjust the speed at which the ball is thrown comprises:

a plurality of locations in said base;

a resilient member connected at one end to said connecting means and the other end being adapted to releasably engage in one of said locations in said base, said end's engagement in various of said locations acting to vary the extent to which said resilient member is stretched when said actuating lever is pivoted thereby varying the extent to which said resilient member brings said connecting means back toward said base such that the speed of said throwing arm is varied due to the drag force of the connecting means.

22. A ball throwing apparatus as claimed in claim 1 in which said base is provided with a pair of parallel upstanding side members and said throwing arm is pivotally mounted between said side members.

* * * * *